United States Patent [19]

Barradas

[11] Patent Number: 4,576,188

[45] Date of Patent: Mar. 18, 1986

[54] HEATABLE ROLLER FOR CURLING HAIR

[76] Inventor: George Barradas, 15 Riverview Ct., Glenville, Conn. 06830

[21] Appl. No.: 582,902

[22] Filed: Feb. 23, 1984

[51] Int. Cl.[4] ..... A45D 2/02

[52] U.S. Cl. ..... 132/39; 132/33 R

[58] Field of Search ..... 132/39, 40, 42, 33

[56] References Cited

U.S. PATENT DOCUMENTS

| | | | |
|---|---|---|---|
| 1,641,353 | 9/1927 | Opper et al. | 132/33 R |
| 3,498,300 | 3/1970 | Lehn | 132/40 |
| 3,696,819 | 10/1972 | Jensen | 132/33 R |
| 3,706,315 | 12/1972 | Johansen | 132/40 |
| 3,766,930 | 10/1973 | Madsen | 132/33 R |
| 4,056,109 | 11/1977 | Takai | 132/40 |
| 4,202,360 | 5/1980 | Walter | 132/40 |

FOREIGN PATENT DOCUMENTS

| | | | |
|---|---|---|---|
| 602577 | 8/1960 | Canada | 132/42 R |

*Primary Examiner*—Gregory E. McNeill
*Attorney, Agent, or Firm*—Alfred E. Miller

[57] ABSTRACT

A roller for curling hair is comprised of a pair of tubular plastic members joined together at one end and having flanges at the other end thereof. The flanges have enlarged diameters and are partially separated from the respective tubular members by vents. A foam plastic sleeve is tightly fit on the outer surfaces of the tubular members between the flanges, without the use of adhesive. The foam sleeve may be formed by die cutting, and subsequent heat shrinking to reduce its wall thickness.

14 Claims, 18 Drawing Figures

FIG.5
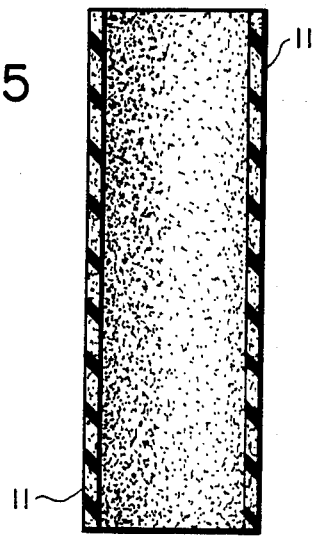
FIG.6
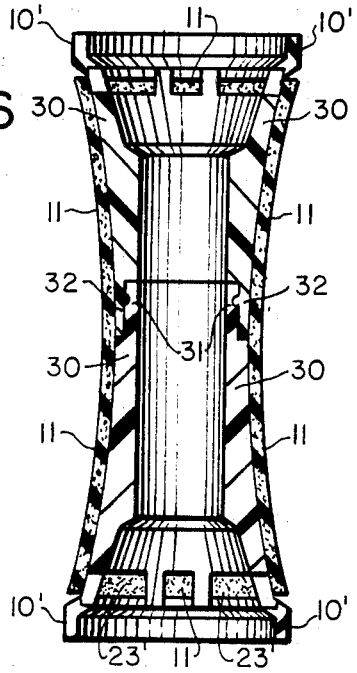
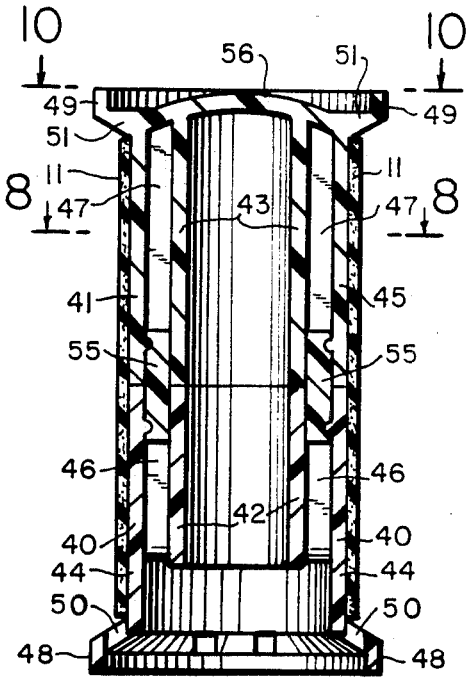
FIG.7
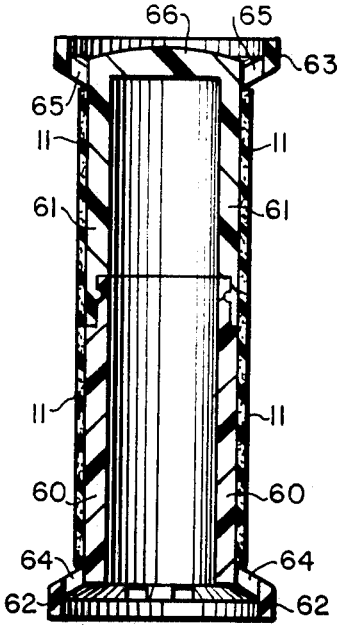
FIG.9
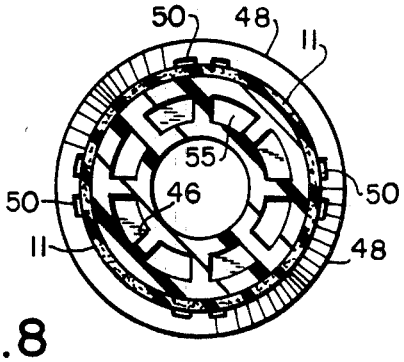
FIG.8
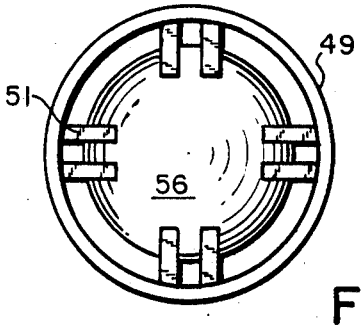
FIG.10

FIG.11
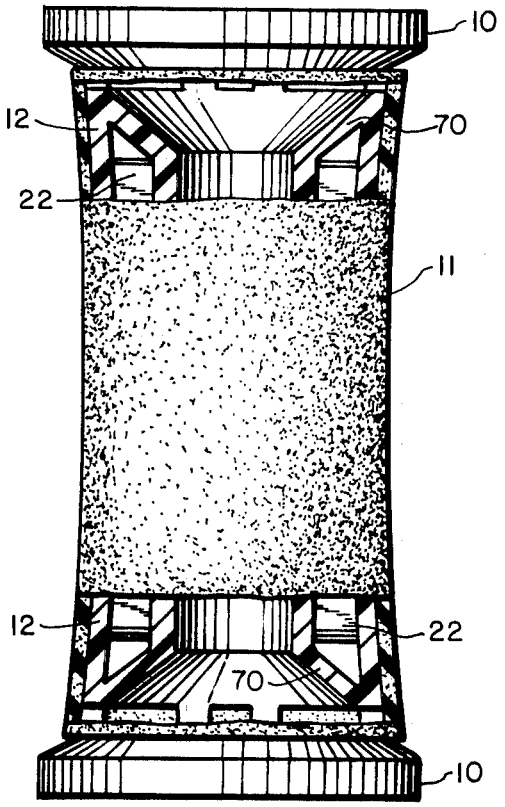
FIG.12
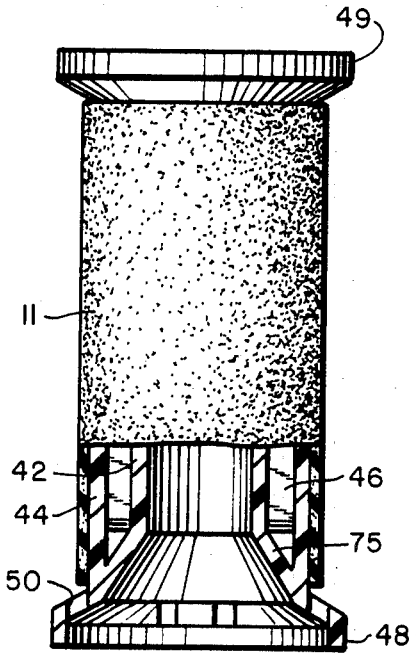
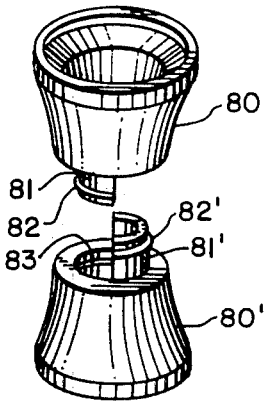
FIG.13
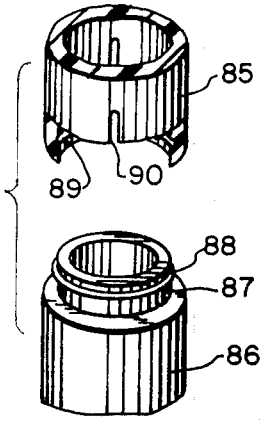
FIG.14

FIG.15
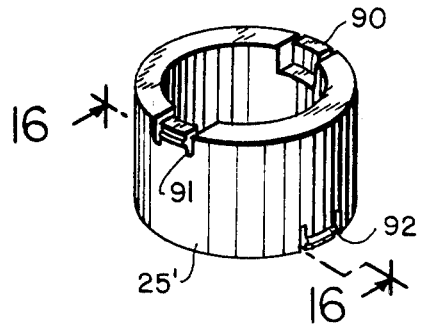
FIG.16
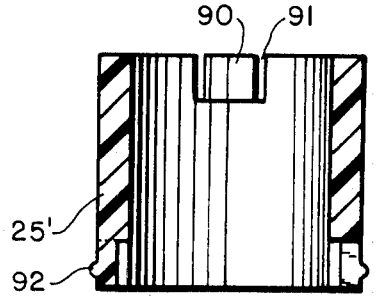
FIG.17
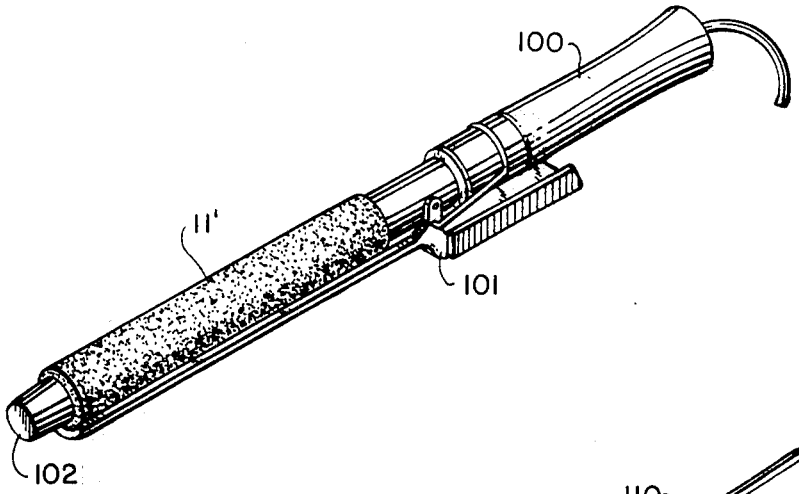
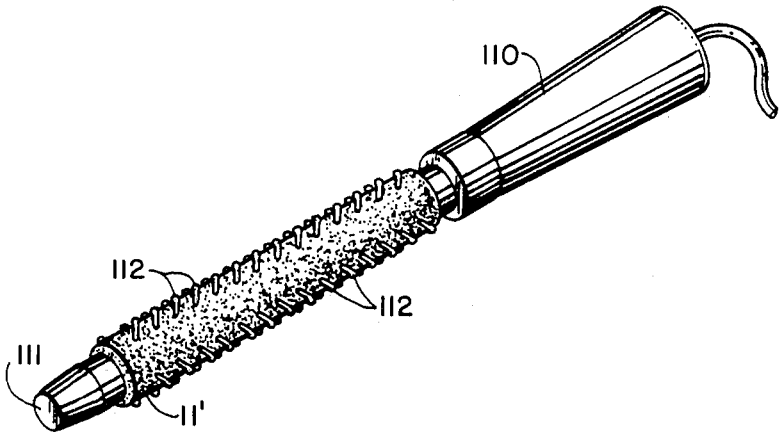
FIG.18

HEATABLE ROLLER FOR CURLING HAIR

This invention relates to rollers for curling hair, and is especially directed to hair curling rollers of the type adapted to be heated by emplacement on heated posts, such as electrically heated posts.

Heatable rollers for curling hair are generally comprised of a cylindrical element having a central aperture enabling the emplacement of the roller on a heated post. At least the central outer portion of the roller is provided with a surface enabling hair to be rolled thereon. For example, as disclosed in U.S. Pat. No. 4,202,360 to Walter, the rolling surface may be in the form of a layer of flocking. Since the rolling surface of the roller may have a temperature that is uncomfortable to the touch, it is conventional to provide the end sections of the rollers with flanges, or the like, coupled or secured to the central roller section by webs or the like, in order to minimize the flow of heat to the flanges.

The present invention is directed to the provision of a roller for curling hair of the above type, wherein the rollers may be fabricated in a manner more economical than heretofore, without sacrificing the ease of use of the roller, and without reducing the heat transfer between the heated posts and rolling surface, or heat retention of the roller.

BRIEF SUMMARY OF THE INVENTION

Briefly stated, in accordance with the invention, a roller for curling hair is comprised of a pair of tubular plastic elements, one end of each element being flanged and the other ends thereof being adapted to be coaxially snapped together. Vents are provided in the tubular elements adjacent the flanged ends, in order to minimize the transfer of heat to such ends.

In order to define a rolling surface for hair, a sleeve of a plastic foam material is fitted over the central portion of the roller, to extend substantially the entire distance between the end flanges.

The tubular elements are preferably formed of a talc filled plastic, such as polypropylene having high thermoconductivity and heat retention, and capable of withstanding temperatures up to, for example, 230° F. to which such rollers may be subject. It is of course apparent that other suitable plastic materials having such characteristics may be alternatively employed.

The central portions of the tubular elements for small diameter rollers may have single walls, while it is preferable that the larger diameter tubular elements have inner and outer walls separated by radially extending ribs. Suitable arrangements are provided for holding the tubular elements together, the holding arrangements preferably, in accordance with the invention, enabling the assembly of the foam sleeves on the rollers while ensuring the necessary thermal mass of the rollers in their central sections.

BRIEF DESCRIPTION OF THE DRAWINGS

In order that the invention may be more clearly understood, it will now be disclosed in greater detail with reference to the accompany drawings, wherein:

FIG. 5 is a longitudinal cross sectional view of the foam sleeve of the roller of FIG. 2;

FIG. 6 is a longitudinal cross sectional view of a modification of the roller of the invention;

FIG. 7 is a longitudinal cross section of another modification of the roller of the invention;

FIG. 8 is an end view of FIG. 7;

FIG. 9 is a longitudinal cross sectional view of a further modification of a roller in accordance with the invention;

FIG. 11 is a partially cross sectional view of a modification of the roller of FIG. 2;

FIG. 12 is a partially cross sectional view of a modification of the roller of FIG. 7;

FIG. 13 is an exploded view of a modified arrangement for holding together the end portions of the roller;

FIG. 14 is an exploded partial view of a further arrangement for holding the roller sections together;

FIG. 15 is a perspective view of a modified insert for holding the roller sections together;

FIG. 16 is a cross sectional view of the insert of FIG. 15;

FIG. 17 is a perspective view of a curling iron employing the foam sleeve of the invention; and FIG. 18 is a perspective view of a curling brush employing the foam sleeve of the invention.

DETAILED DISCLOSURE OF THE INVENTION

Figure 1:
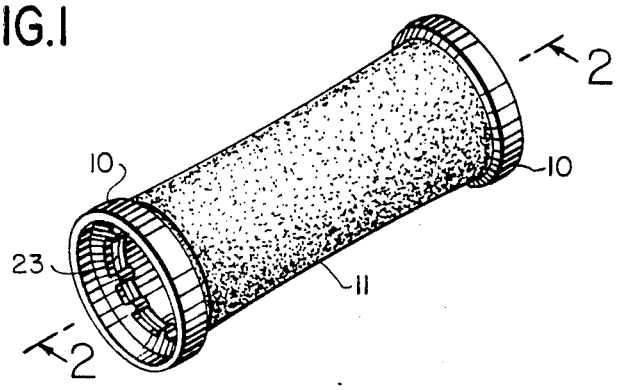
FIG. 1 is a perspective view of one embodiment of a roller for curling hair in accordance with the invention.

Referring now to FIG. 1, therein is illustrated a perspective view of a roller for curling hair, in accordance with the invention. The roller as illustrated in FIG. 1 is generally tube-shaped, having plastic end flanges 10 adapted to be gripped by the user for manipulating the roller. The central hair rolling portion of the roller is comprised of a sleeve 11 of a suitable foam material, such as polyester foam. As will be apparent from the following description, the end flanges 10 define the end portions of a pair of plastic members which are held together at the axial center of the roller, these tube-shaped elements defining a surface for supporting the foam sleeve 11. Since the tube-shaped plastic elements may be readily fastened together, the foam sleeve 11 may be readily assembled thereon without the necessity of employing an adhesive. This feature enables the material contacting the hair to be less dense than, for example, flocking glued to a shell, and hence to be capable of improved heat transfer to the hair. The arrangement provides the further advantage that the foam sleeve may be pre-formed as a sleeve, for example by cutting in a die, thereby minimizing the cost and effort required for providing the hair grooming surface on the roller.

Figure 2:
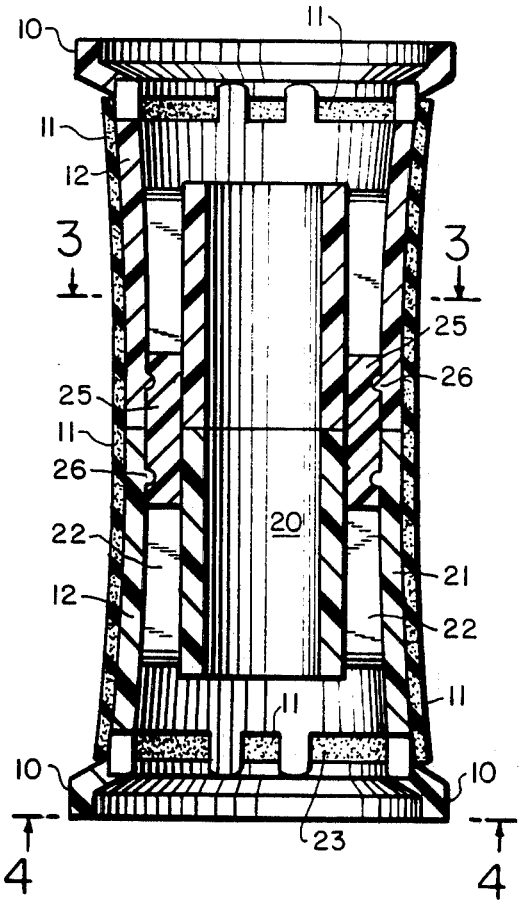
FIG. 2 is a longitudinal cross sectional view of one embodiment of a roller in accordance with the invention.
Figure 3:
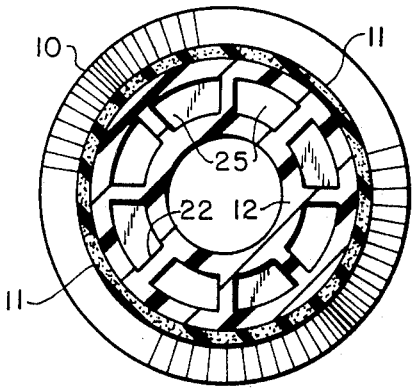
FIG. 3 is a transverse cross sectional view of the roller of FIG. 2 taken along the lines 3—3.
Figure 4:
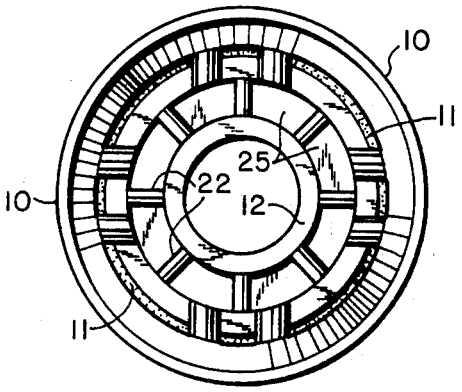
FIG. 4 is an end view of the roller of FIG. 2.

In the environment of the invention illustrated in FIGS. 2, 3 and 4, the body of the roller is comprised of a pair identical tubular members 12 of a good heat transfer material having a high heat retention, and a high heat resistance to enable its use at temperatures greater than about 230° F. The members 12 are preferably injection molded of, for example, a conventional talc filled plastic material or polypropylene, it of course being apparent that other materials having these properties may be employed.

In the embodiment of the invention illustrated in FIGS. 2, 3 and 4, for a relatively large hair roller, the body elements 12 are formed with inner tubular portions 20 extending from the axial center of the roller but terminating short of the end of the roller. A coaxial tubular outer body portion 21 of greater diameter is held on the inner portion 20 by radial extending webs 22. As an example, in the illustrated embodiment of the invention eight such webs 22 are provided, it being of course apparent that the invention is not limited to such number. The tubular portions 21 extend from the axial center of the roller, and terminate in the end flanges 10 of greater diameter. The end flanges 10 have a sufficient axial length to enable them to be grasped by the user and turned. A plurality of vents 23 separate the end flanges from the central portions of the tubular members 21, in order to reduce the conduction of heat to the end flanges 10, thereby enabling the operator to manipulate the rollers by the end flanges without burning one's fingers or other discomfort. As illustrated in FIG. 2, the longitudinal cross section of the outer tubular portion 21 may have a curvature, with the axial ends thereof being of greater diameter than the central portion of the roller. This contour may advantageously simplify the curling of hair on the roller.

In order to hold the body elements 12 together, an annular insert 25 of the same material as the members 12 is inserted to extend between the inner and outer tubular members 20 and 21 of each of the body members 12. The webs 22 of the body members 12 thus do not extend to the axial center of the roller, in order to permit insertion of the insert 25 therein. The insert 25 may be held in the members 12 by any conventional means, for example, annular grooves 26 on the outer circumference of the insert may be snapped over corresponding annular ridges on the body members 12, for example, on the inner surface of the tubular portions 21.

By providing identical body members 12, the production costs of the rollers is minimized. The simple holding together of the body members by an insert 25 simplifies the assembly of the rollers, without requiring any substantial assembly procedure. Alternatively, of course, it is apparent that other forms of holding the elements together may be provided, for example, by sonic welding of the body members 12 and insert 25. The provision of initially separate end portions of the body also permit the assembly of the foam sleeve 11 on the body members 12 in a simple manner, prior to snapping or otherwise holding the body elements together.

The foam sleeve, as illustrated in FIG. 5, is formed of a simple tubular material having a thickness, for example, of $\frac{1}{8}$ inch. The sleeve is preferably formed by die cutting a foam plastic material such as klicker polyester foam. Die cutting of the sleeves in this manner thereby enables the provision of sleeves that do not have joints, so that the outer circumference of the sleeves may be smooth and uniform. In conventional die cutting processes, it is not feasible at this time to obtain wall thicknesses of the sleeve less than about $\frac{1}{8}$ inch. Such thickness is greater than desired for the heat transfer between the outer surface of the roller members 12 and the hair, and thus, in accordance with the invention, after the die cutting of the sleeves, they are heat formed to reduce their thickness to about 1/16 of an inch. For this purpose, heat treatment of about 380° F. for five seconds has been found to reduce the wall thickness to about 1/16 inch. A desirable result is that certain physical properties of the foam sleeve are increased, such as tensile strength and elongation. Further reduction of the wall thickness, to improve heat transfer, may be effected by stretching of the sleeves on the roller, i.e., forming the sleeve with a diameter less than that of the roller, so it must stretch to be fit on the roller. Stretching thus enables the further reduction of thickness of the foam sleeve to about 0.05 inches, a thickness which has been found suitable for the necessary heat transfer to the hair, while still providing a soft surface upon which the hair may be readily rolled. It should be apparent that the use of a soft foam sleeve on the outer surface of roller member 12 prevents the breakage of hair ends which are twisted and twirled around the roller. In addition, because of the body elements 12 may be pulled apart, the foam sleeve can be washed, and even replaced, if necessary. The thin foam sleeve, as employed in the invention, hence does not require any adhesive that would reduce the heat transfer to the hair. For large rollers having lengths of about $2\frac{1}{2}$ inches and central outer diameters of about 0.80 inches, it has been found that foam sleeves having an initial inner diameter of about $\frac{5}{8}$ inches, produced in the above described process, forms a suitable foam layer on the roller.

The embodiment of the invention illustrated in FIG. 6, is employed for smaller diameter rollers. In this embodiment of the invention, as in the embodiment of FIG. 2, the roller is fully internally open to enable its emplacement on a heating rod from either end. The roller body elements 30 in this case have sold walls which extend from the axial center of the roller to the end flanges 10' of larger diameter. The end flanges 10' being separated from the axial central portions on the roller by vents 23' for reducing the transfer of heat. The two body elements 30 may be affixed together by any conventional means, for example, by having axial extensions 31, 32 that snap together while retaining a smooth outer surface. As in the embodiment in FIG. 2, the longitudinal cross section of the roller body may have an arcuate outer surface to improve the rolling of hair thereon. It is of course apparent that any other conventional technique may be employed for affixing the two body portions 30 together after assembly of the sleeve 11 thereon.

In the embodiment of the invention for a small roller, of FIG. 6, the walls of the roller may be solid to enable the necessary heat transfer from the heated post (not shown) to the hair since the thickness required may be readily molded without the necessity of mold marks on the surface of the roller that would require removal. The use of single thickness body members for the large roller of FIG. 2 would result, however, in undesirable mold marks, in view of the required thickness for a large diameter roller. Such disadvantage is overcome in the embodiment of FIG. 1 by molding the body members with relatively thin inner and outer tubular portions joined by a web. As a consequence, the exterior surface of the rollers may be formed smooth in the extrusion molding process, without the necessity of further working of the surface. Since the interconnection of the inner and outer tubes by radially extending webs results in a reduced heat transfer between the interior of the roller and the external surface, the necessary heat may be transferred between the inner and outer surface by way of the molded insert 25. The insert 25 hence serves the multiple functions of simplifying the interconnecting of the members 12 of FIG. 2, enabling the adequate transfer of heat between the inner and outer tubes 20, 21, as well as serving as a further heat storage element.

The embodiment of the invention illustrated in FIGS. 7, 8 and 10 is a modification of the roller of FIG. 2, wherein one end of the roller is closed. In this embodiment, the two body members 40, 41 are somewhat differently shaped, although they each have an interior tube portion 42, 43 respectively an outer tube portion 44, 45 respectively joined by radially extending webs 46, 47 respectively, and an axially outer enlarged flange 48, 49, with vents 50, 51 respectively separating the flanges from the axial center portions thereof. A central annular insert 55 is provided holding the two ends of the roller together while ensuring adequate heat transfer, as in the embodiment of FIG. 2. In the arrangement of FIGS. 7 and 8, however, the body member 41 is provided with a wall 56 at its axial extremity, covering the central hole in the roller.

In the modification of the invention illustrated in FIG. 9, for a smaller closed end roller, the body is comprised of a pair of coaxial tubular portions 60, 61 snapped or otherwise held together. The body portions 60, 61 have end flanges 62, 63 respectively separated from their respective body portions by vents 64, 65 respectively. As distinguished from the embodiment of the invention of FIG. 6, an end wall 66 is provided on the body member 61 of FIG. 9 to close the central aperture of the roller. The embodiments of the invention of FIGS. 7–9 have been illustrated with straight side walls. It is of course apparent that these walls may be curved as in the embodiment of FIG. 2, or, alternatively, that the embodiment of FIGS. 2 and 6 may have straight side walls.

The embodiments of the invention of FIGS. 7–9 have the advantages of the previously described embodiments, of economical fabrication with adequate heat storage and heat transfer to the hair without the necessity of employing adhesive, the outer surface of the roller being soft and enabling the hair to be readily rolled thereon.

In the modification of the roller of FIG. 1 as illustrated in FIG. 11, walls 70 are provided extending between the inner tubular elements 20 and the outer tubular body portion 21, the walls 70 extending from the axial ends of the inner tubular portions 20 at an angle to the axis of the roller. The end walls 70 may be provided in order to increase the heat transfer from the inner tubular portion to the outer wall. This effect is also provided in the modification of the roller of FIG. 7 as illustrated in FIG. 12, wherein the roller axial end of the inner tubular portion 42 is joined to the outer tubular portion 44 by means of a wall 75 extending at an angle to the axis of the roller.

In accordance with a further embodiment of the invention, as illustrated in FIG. 13, the end portions 80 and 80' of the roller may be configured in order to enable their separation and assembly in a simple manner, so that the user may be able to easily assembly a foam sleeve thereon, or substitute a foam sleeve. For this purpose, each of the roller portions 80 and 80'0 is provided with an axial projection 81, the projections having generally semicircular outer peripheries in a cross section to enable them to be received in a corresponding recess in the other forward end portion. The projections 81 will be further provided with ridges 82, 82' on their outer surfaces, and adapted to snap into corresponding recesses 83 in the inner portions of the tubular end sections 80, 80'. In this arrangement, in order to separate the end roller portions for replacement or assembly of a foam sleeve thereon, it is merely necessary to pull apart the end sections 80, 80'. The assembly may of course be effected simply by aligning the projections 81, 81' with the corresponding recesses of the roller end portions 80' and 80, respectively, and forcing the end portions 80, 80' together.

Instead of providing the end portions of the roller with projections, as illustrated in FIG. 13, having generally hollow semi-circular cross section, one end portion 86 of the roller may be provided with an annular coaxial projection 87, as illustrated in FIG. 14. In this embodiment of the invention the other roller end portion 85 is provided with a corresponding recess for receiving the annular projection 87. In order to enable the end portions to be snapped together, an annular ridge 88 may be provided on the outer circumference of the projection 87, adapted to be received by a corresponding recess 89 of the other roller section 85. Axially extending slots 90 in the roller portion 85 provide a certain degree of springiness, to facilitate the snapping together of these elements. The end portions of the roller may hence be readily separated by pulling them apart with a small amount of force, and may be readily snapped together also with a small amount of axial force.

In the embodiment of the invention of FIG. 2, the insert 25 was held between the inner and outer tubular portions of the roller into the provision of annular ridges 26 on the roller portions engaging corresponding recesses in the insert. In the modified form of the insert 25', as illustrated in FIGS. 15 and 16, the insert is provided with adjacent pairs of axially extending slots 91 at each end, defining tongues 90 therebetween. The tongues 90 are formed with circumferentially extending ridges 92 on their outer surfaes. In addition, the inner portions of the tongues 90 are relieved, to have a lesser wall thickness than the remainder of the insert 25'. Due to the separation of the sides of the inserts 90 from the remainders of the walls of the insert 25', these tongues 90 are resilient, so that the use of the insert 25' of FIGS. 15 and 16 in place of the insert 25 in the embodiment of the invention of FIG. 2, enables the ready separation and assembly of the roller end portions. As a consequence, the foam sleeve may be readily assembled on or removed from the roller.

The foam sleeve of the invention is also especially useful on a curling iron, such as illustrated in FIG. 17. The curling iron has a handle 100 from which extends a heated end portion 102. The foam sleeve 11', fabricated in accordance with the invention as above discussed, may be slipped over the end portion 102, to engage the conventional clamp portion 101.

The foam sleeve may also be employed in combination with a curling brush, as illustrated in FIG. 18. The curling brush of FIG. 18, in conventional manner, has a handle 110 from which a heated end portion 111 extends. The foam sleeve of the invention is slipped on the end portion 111. The curling brush has radially extending fingers extending through the foam sleeve 11'. Withdrawal of the fingers 112, to permit assembly and disassembly of the foam sleeve, is effected by relative rotation of the end portion 111 and the handle 110, as in conventional manner.

While the invention has been disclosed and described with reference to a limited number of embodiments, it is apparent that variations and modifications may be made therein, and it is therefore intended in the following claims to cover each such variation and modification as falls within the true spirit and scope of the invention.

What is claimed is:

1. A roller for curling hair comprising a pair of coaxial tubular members having the same outer diameters and being axially affixed together at one respective end whereby said ends abut each other and each having a flange of enlarged diameter at the other respective end thereof, the flanges being partially separate from the respective tubular members by vents extending through the tubular members, and a removable foam sleeve covering the outer radial surface of said tubular members between the flanges thereof and non-adhesively held thereon.

2. The roller of claim 1 wherein said tubular members are extrusion molded of a plastic material having high heat transfer and withstanding temperatures of at least 230° F.

3. The roller of claim 2 wherein said tubular members are of a talc-filled plastic material.

4. The roller of claim 2 wherein said tubular members are of polypropylene.

5. The roller of claim 1 wherein said tubular members have axially straight external walls between the flanges thereof.

6. The roller of claim 1 wherein said tubular members have arcuate external walls between said flanges, with a minimum diameter at the center of the roller.

7. The roller of claim 1 wherein said tubular members have substantially solid walls between said flanges, from the inner to the outer diameter thereof.

8. The roller of claim 1 wherein said tubular members have inner tubular portions joined to outer coaxial tubular portions of larger diameter by radially extending webs, said flanges being joined to the outer portions.

9. The roller of claim 8 further comprising a single tubular insert extending between the inner and outer tubular portions of each of said tubular members and positioned adjacent to the abutting ends of said tubular members to thereby hold said tubular members axially together.

10. The roller of claim 9 wherein said insert is of the same material as said tubular members, and increases heat transfer between the inner and outer tubular portions.

11. The roller of claim 1 wherein said foam sleeve is stretched on said tubular members.

12. The roller of claim 11 wherein said foam sleeve has a thickness of about 0.05 inches.

13. The roller of claim 1 wherein said sleeve is die cut.

14. The roller of claim 13 wherein said die cut sleeve is formed by die cutting to a wall thickness of at least $\frac{1}{8}$ inch and thereafter heat-shrunk.

* * * * *